United States Patent [19]

Gehmecker et al.

[11] Patent Number: 4,950,339

[45] Date of Patent: Aug. 21, 1990

[54] PROCESS OF FORMING PHOSPHATE COATINGS ON METALS

[75] Inventors: Horst Gehmecker, Gross-Gerau; Werner Rausch, Oberursel; Peter Jörns, Frankfurt, all of Fed. Rep. of Germany

[73] Assignee: Metallgesellschaft Aktiengesellschaft, Frankfurt am Main, Fed. Rep. of Germany

[21] Appl. No.: 305,214

[22] Filed: Feb. 1, 1989

[30] Foreign Application Priority Data

Feb. 3, 1988 [DE] Fed. Rep. of Germany ..... 3803068

[51] Int. Cl.[5] ..... C23C 22/17; C23C 22/86

[52] U.S. Cl. ..... 148/262

[58] Field of Search ..... 148/262, 246, 259, 260; 106/1.13

[56] References Cited

U.S. PATENT DOCUMENTS

| | | | |
|---|---|---|---|
| 3,432,270 | 3/1969 | Heller | 148/262 |
| 3,516,875 | 6/1970 | Rausch | 148/262 |
| 3,519,494 | 7/1970 | Engesser | 148/262 |
| 3,520,737 | 7/1970 | Gerassimoff | 148/262 |
| 3,617,393 | 11/1971 | Nakazawa | 148/262 |
| 3,647,568 | 3/1972 | Larson | 148/262 |
| 3,676,224 | 7/1972 | Shee | 148/262 |
| 3,723,192 | 3/1973 | Oei | 148/262 |
| 3,758,349 | 9/1973 | Engesser | 148/262 |
| 3,767,476 | 10/1973 | Wagner | 148/262 |
| 3,810,792 | 5/1974 | Ries | 148/262 |
| 3,850,700 | 11/1974 | Heller | 148/262 |
| 3,860,455 | 1/1975 | Hansen | 148/262 |
| 3,939,014 | 2/1976 | Reed | 148/262 |
| 4,113,519 | 9/1978 | Oka | 148/262 |
| 4,199,381 | 4/1980 | Nuss | 148/246 |
| 4,265,677 | 5/1981 | Muller | 148/262 |
| 4,338,141 | 7/1982 | Senzaki | 148/262 |
| 4,389,260 | 6/1983 | Hauffe | 148/262 |
| 4,416,705 | 11/1983 | Siemund | 148/262 |
| 4,419,199 | 12/1983 | Hauffe | 148/260 |
| 4,596,607 | 6/1986 | Huff | 148/262 |
| 4,713,121 | 12/1987 | Zurilla | 148/262 |
| 4,717,431 | 1/1988 | Knaster | 148/262 |
| 4,719,038 | 1/1988 | Sobata | 106/1.13 |
| 4,824,490 | 4/1989 | Oei | 148/259 |

FOREIGN PATENT DOCUMENTS

| | | | |
|---|---|---|---|
| 0045110 | 10/1984 | European Pat. Off. | 148/262 |
| 2540684 | 3/1977 | Fed. Rep. of Germany | 148/262 |
| 2080835 | 2/1982 | United Kingdom | 148/262 |

*Primary Examiner*—Jay H. Woo
*Assistant Examiner*—Jeremiah F. Durkin, II
*Attorney, Agent, or Firm*—Felfe & Lynch

[57] ABSTRACT

A process to form phosphate coatings on individual parts of metal which at least on part of their surface consists of iron or steel. The individual parts are contacted at a temperature in the range of from 60 to 100 degrees centigrade for 3 to 30 seconds with an aqueous phosphating solution which contains 10 to 80 g/l zinc, 12 to 80 g/l phosphate (calculated as $P_2O_5$), 40 to 150 g/l nitrate and, in addition 0.1 to 10 g/l fluoride, 0.01 to 10 g/l nickel, 0.0001 to 0.1 g/l copper, and may also contain tartaric acid, citric acid and/or manganese and in which the ratio of free acid to total acid has been adjusted to (0.1 to 0.3):1 and which contains at least 80 points of total acid and is virtually free of iron(II) ions. Prior to phosphating treatment, the individual parts may be cleaned and may optionally be treated to remove rust, scale and phosphate layers and/or be activated. After the phosphating treatment they may be passivated with an after-rinse solution. Each of said process steps is carried out for 3 to 30 seconds.

18 Claims, No Drawings

PROCESS OF FORMING PHOSPHATE COATINGS ON METALS

BACKGROUND OF THE INVENTION

The present invention is in a process of forming a phosphate coating on an individual part which consists of metal and the surface of which consists, at least in part, of iron or steel. The process of the invention employs an aqueous phosphating solution which is virtually free of iron(II) ions and contains zinc ions, phosphate ions, nitrate ions and autocatalytically formed nitrite ions.

It is known that workpieces which at least on part of their surfaces consist of steel or iron, such as individual parts, e.g., air filter housings, deep drawn brake parts, vehicle wheels, and other parts of automobile accessories, can be provided with zinc phosphate coatings. This is accomplished, inter alia, with phosphating solutions, which in addition to zinc ions and phosphate ions contain nitrate ions as accelerators. Such phosphating solutions are usually employed "on the iron side", i.e., while the solution is used it becomes enriched with iron which has been dissolved from the iron or steel surface by the pickling action. Chlorate is added at a controlled rate to maintain the content of iron(II) ions below the limit at which the phosphate coating begins to deteriorate. This addition keeps the iron(II) concentration in the range of from 0.05 to 1% by weight (EP-B-0 045 110).

Zinc phosphating processes of a different kind usually employ high nitrate contents and are carried out at elevated temperatures and distinguish in that the phosphating solutions in use are virtually free of iron(II) ions. In that case, autocatalytically formed nitrite transforms the iron(II) ions to iron(III) ions, which together with phosphate ions, form difficultly soluble iron phosphate (DE-A-25 40 684).

Each of the mentioned processes have in common that the formation of the phosphate coatings takes a relatively long treating period of 5 to 15 minutes.

In practice, a treatment for such long periods often can be performed only with relatively expensive equipment. For this reason processes which can be carried out within a shorter time are preferred. This is particularly desirable when the surface treatment is to be integrated in existing production sequences, which are used to treat individual parts, e.g., of the kind mentioned hereinbefore.

It is an object of the invention to provide a process for the formation of phosphate coatings on individual parts which at least in part of their surface consist of iron or steel which does not have the disadvantage that a long treating period is required and which permits phosphate coatings of high quality to be formed within a short time.

THE INVENTION

The above-stated objects and others are obtained by the invention wherein the individual part is contacted at a temperature in the range of from 60° to 100° C. for 3 to 30 seconds with an aqueous phosphating solution which is virtually free of iron(II) ions and comprises 10 to 80 g/l zinc,
12 to 80 g/l phosphate (calculated as $P_2O_5$),
40 to 150 g/l nitrate and, in addition
0.1 to 5 g/l fluoride,
0.01 to 10 g/l nickel, and
0.001 to 0.1 g/l copper.

The solution has a ratio of free acid to total acid adjusted to (0.1 to 0.3):1 and contains at least 80 points of total acid.

Whereas nitrite is autocatalytically formed—as has been explained hereinbefore—it may be necessary to add nitrite to the phosphating solution, e.g., in an amount of 0.03 to 0.2 g/l, while the process is starting up.

The process in accordance with the invention is particularly useful to treat individual parts which on their iron or steel surfaces contain alloying additions up to 5% by weight. The part may have a surface with an iron or steel content of as little as 1%.

The several components of the phosphating solution, such as zinc, phosphate, nitrate etc., are predissolved in most cases to form an acid phosphating concentrate, as is usual in phosphating technology, and are introduced in that form into the phosphating solution. The amounts of the various components are so controlled that concentrations in the required ranges are obtained and maintained in the phosphating solution.

For the adjustment of the required ratio of free acid to total acid it may be necessary to use additional cations of the alkali metal and/or ammonium group. Zinc oxide and/or zinc carbonate may optionally be used and may be added to the phosphating solution as a powder or as an aqueous slurry.

To determine the free acid and the total acid, bath samples of 10 ml are titrated with N/10 NaOH against the first or second end point of the phosphoric acid. The end point may be indicated, e.g., by the color change of dimethyl yellow (free acid) or phenolphthalein (total acid). The consumption of N/10 NaOH in milliliters corresponds to points of free acid and total acid, respectively.

The number of nitrite points is usually determined by saccharimetry. For that purpose, 2 to 5 grams sulfamic acid are added to a 50 ml bath solution. The amount of gas thus formed in milliliters equals the number of points. One gas point corresponds to a content of 46 mg/l $NO_2$ in the phosphating solution. The method is described in U.S. Pat. No. 3,432,270.

Although a spray technique is applicable, the individual parts are preferably contacted with the phosphating solution by immersion or flooding.

In dependence on the bath composition, treating time, and treating temperature, the phosphate coatings formed by the process according to the invention have a weight of from 2.0 to 10 g/m$^2$.

According to a highly preferred embodiment of the invention the individual part is contacted with a phosphating solution which contains 30 to 60 g/l zinc,
30 to 50 g/l phosphate (calculated as $P_2O_5$),
65 to 100 g/l nitrate,
0.5 to 3.0 g/l fluoride, and
0.02 to 0.5 g/l nickel.

The rate at which the phosphate coating is formed can be increased if, according to a further preferred feature of the invention, the individual part is contacted with a phosphating solution which contains additional accelerating additives. Such accelerating additives may consist, e.g., of chlorate, bromate, peroxide, m-nitrobenzene sulfonate, nitrophenol or combination thereof.

The properties of the phosphate coatings can be improved further if, in accordance with a further preferred embodiment of the invention, the individual part is contacted with a phosphating solution which additionally contains 0.1 to 10 g/l, and preferably 1 to 5 g/l, manganese.

To form light weight coatings it is desirable in another highly preferred embodiment of the invention to contact the individual part with a phosphating solution which additionally contains 0.05 to 3 g/l tartaric acid and/or citric acid.

In accordance with a further desirable feature of the invention, the individual part, before being phosphated, is cleaned and optionally treated for removal of rust, scale and phosphate layers and is activated. When the part has been phosphated, it is passivated with an afterrinse solution. Each of the above process steps is carried out for a period of 3 to 30 seconds.

It has been found that it is desirable to perform the cleaning with an alkaline cleaning solution which is at a temperature in the range of from 60° to 100° C. and has a concentration in the range of from 20 to 200 g/l. Particularly desirable cleaners contain mainly sodium hydroxide, gluconate and phosphate and additionally contain carbonate, silicate and borate as well as a surfactant. The cleaning solution is preferably applied by spraying.

It also has been found that solutions of sulfuric acid or phosphoric acid, which are at a temperature in the range of from 60° to 100° C. and have a concentration in the range of from 5 to 50% by weight, can desirably be used to remove rust, scale and phosphate layers from the metal surface if such removal is required. In accordance with a preferred further feature the sulfuric acid or phosphoric acid additionally contains iron(II) ions and/or iron(III) ions in a concentration in the range of from 1 to 50 g/l. Particularly favorable results will be obtained if such pickling solutions are employed.

After any removal of rust, scale and phosphate layers it is recommended that the individual parts be contacted with a solution which contains the same acids in concentrations in the range of from 0.3 to 3% by weight and at a temperature of only 20° to 50° C. As a result, the metal salts which may have formed on the metal surfaces as the pickling solution was dried after the individual parts have been removed from that solution can easily be redissolved. A renewed formation of such deposits formed by the acid rinsing solution as it is dried will effectively be avoided because the bath temperature is lower than that of the pickling bath.

While not essential, it is desirable to activate the individual parts in a manner known per se with a dispersion which consists of an aqueous slurry of titanium phosphate and which may in addition contain condensed phosphate so that a finely crystalline phosphate coating is formed.

The phosphating treatment is usually succeeded by a rinse with water, optionally by an afterrinse, and by drying as necessary.

In order to improve the resistance to corrosion a further desirable feature of the invention resides in that the individual parts are passivated with an afterrinse solution. The afterrinse solution may contain or may be free of chromium. An emulsion of a corrosion-protective oil may be used for an aftertreatment or the parts may be painted, with or without being passivated. If cold working is intended, an after-treatment with a soap bath may be performed.

The phosphate coatings formed by the process in accordance with the invention can be used to advantage in all fields in which phosphate coatings are employed. Special advantages are obtained by the phosphating process of the invention if it is used to improve the resistance to corrosion before a painting treatment.

EXAMPLE

Deep drawn automobile accessories of grade C15 steel were treated as follows:

Cleaning:
- 69% NaOH
- 24% sodium gluconate
- 4% sodium hexametaphosphate
- 3% surfactant
- 100 g/l, 90°–95° C., spraying for 10 seconds.

Rinsing: Hot water, 80°–90° C., immersion for 10 seconds.

Pickling-descaling: 20% $H_3PO_4$, 90°–95° C., immersion for 10 sec.

Rinsing: 1% phosphoric acid, room temperature, immersion for 10 seconds

Rinsing: Fresh water, room temperature, immersion for 10 seconds

Activating: 2 g/l titanium phosphate, 40° C., immersion for 10 seconds

Phosphating:
- 44 g/l Zn
- 6.4 g/l Na
- 0.05 g/l Ni
- 0.008 g/l Cu
- 83 g/l $NO_3$
- 38 g/l $P_2O_5$
- 1.6 g/l F
- Free acid: 29.5 points
- Total acid: 150 points
- Nitrite: 5 points
- 85° C., immersion for 10 seconds Rinsing: Fresh water, room temperature, immersion for 10 seconds Afterrinse: 50° C., 0.1 g/l Cr(VI), immersion for 10 seconds Rinsing: Deionized water, showering for 10 seconds, room temperature The phosphate coating obtained after that sequence of operations had a weight of 4 to 5 g/m$^2$. The phosphate coating provided a uniform coverage and was finely crystalline.

It will be understood that the specification and examples are illustrative but not limitative of the present invention and that other embodiments within the spirit and scope of the invention will suggest themselves to those skilled in the art.

I claim:

1. A process of forming a phosphate coating on a part which consists of metal and at least on part of its surface consists of iron or steel comprising:

contacting the part at a temperature in the range of from 60° to 100° C. for 3 to 30 seconds with an aqueous phosphating solution virtually free of iron(II) ions and which comprises 10 to 80 g/l zinc, 12 to 80 g/l phosphate (calculated as $P_2O_5$), 40 to 150 g/l nitrate as accelerator and, in addition 0.1 to 5 g/l fluoride, 0.01 to 10 g/l nickel, 0.001 to 0.1 g/l copper, and in which the ratio of free acid to total acid is (0.1 to 0.3):1 and which contains at least 80 points of total acid.

2. The process of claim 1 wherein the individual part is contacted with a phosphating solution which comprises
30 to 60 g/l zinc,
30 to 50 g/l phosphate (calculated as $P_2O_5$),
65 to 100 g/l nitrate,
0.5 to 3.0 g/l fluoride, and
0.02 to 0.5 g/l nickel.

3. The process of claim 1 wherein the phosphating solution additionally contains at least one additional accelerator.

4. The process of claim 1 wherein the phosphating solution additionally contains 0.1 to 10 g/l, of manganese.

5. The process of claim 1 wherein the phosphating solution additionally contains 0.05 to 3 g/l of at least one of tartaric acid and citric acid.

6. The process of claim 1 wherein the individual part before being phosphated is cleaned.

7. The process of claim 6 wherein the individual part is activated.

8. The process of claim 7 wherein the individual part when phosphated is passivated with an afterrinse solution.

9. The process of claim 8 wherein the individual steps are each carried out for 3 to 30 seconds.

10. The process of claim 6 wherein the individual part is cleaned with an alkaline cleaning solution which is at a temperature in the range of from 60° to 100° and has a concentration in the range from 20 to 200 g/l.

11. The process of claim 6 wherein the individual part is contacted with an acid solution selected from the group consisting of a sulfuric acid solution and a phosphoric acid solution, said acid solution being at a temperature in the range of from 60° to 100° C. and having a concentration in the range of from 5 to 50% by weight.

12. The process of claim 11 wherein the sulfuric acid solution or phosphoric acid solution also contains at least one of iron(II) and iron(III) ions in a concentration in the range of from 1 to 50 g/l.

13. The process of claim 11 wherein after the treatment with the acid solution the individual part is contacted with a solution which contains one of the acids in a concentration in the range of from 0.3 to 3% by weight and is at a temperature of from 20° to 50° C.

14. The process of claim 1 wherein the individual part is activated with a dispersion which contains an aqueous slurry of titanium phosphate.

15. The process of claim 14 wherein the slurry also contains condensed phosphates.

16. The process of claim 1 wherein the part to which the phosphate coating has been applied is passivated with an afterrinse solution.

17. The process of claim 1 wherein the phosphating solution additionally contains 1 to 5 g/l of manganese.

18. The process of claim 6 wherein the individual part before being phosphated, is treated for removal of rust, scale and phosphate layers.

* * * * *